United States Patent [19]

Jimenez et al.

[11] Patent Number: 4,936,234

[45] Date of Patent: Jun. 26, 1990

[54] SEWING MACHINE WITH RETRACTABLE BOBBIN-CARRYING ROD AND THREAD GUIDE

[75] Inventors: Antonio Jimenez, Meyrin; Ingeborg Beau, Versoix, both of Switzerland

[73] Assignee: Mefina S.A., Fribourg, Switzerland

[21] Appl. No.: 347,038

[22] Filed: May 4, 1989

[30] Foreign Application Priority Data

May 9, 1988 [CH] Switzerland ..... 1757/88

[51] Int. Cl.[5] ..... D05B 43/00; D05B 73/00

[52] U.S. Cl. ..... 112/259; 112/302

[58] Field of Search ..... 112/259, 302, 270, 258; 223/102, 106, 108; 242/134

[56] References Cited

U.S. PATENT DOCUMENTS

| | | | |
|---|---|---|---|
| 2,900,941 | 8/1959 | Platt . | |
| 3,444,833 | 5/1969 | Blackwood et al. . | |
| 3,954,073 | 5/1976 | Varin | 112/259 |
| 3,990,375 | 11/1976 | Adams | 112/258 |
| 4,522,324 | 6/1985 | Schneider-Muro | 223/102 |

FOREIGN PATENT DOCUMENTS

| | | | |
|---|---|---|---|
| 3613684 | 6/1987 | Fed. Rep. of Germany . | |
| 659674 | 2/1987 | Switzerland . | |
| 958742 | 5/1964 | United Kingdom | 223/106 |

*Primary Examiner*—Andrew M. Falik

*Attorney, Agent, or Firm*—Young & Thompson

[57] ABSTRACT

A handle (2) for a sewing machine has two arms (8, 9) which are swingably mounted on the handle to be retracted into recesses (6, 7) of the handle when they are not used. One arm (8) carries a rod (14) to receive a bobbin (15) and a disc (16), while the other arm (9) has a thread guide (18) for the thread (17) from the bobbin (15). The handle can also be designed to carry two rods for use with two threads.

11 Claims, 2 Drawing Sheets

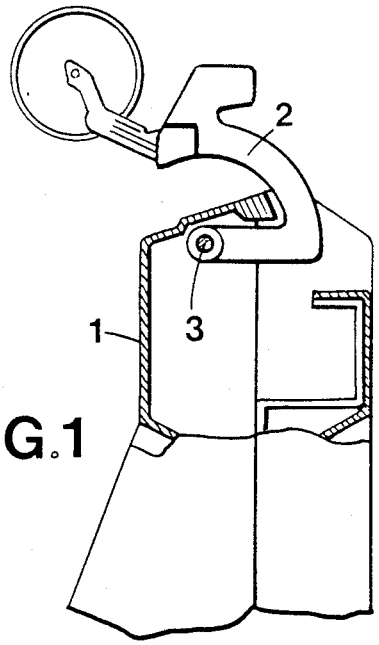
FIG. 1
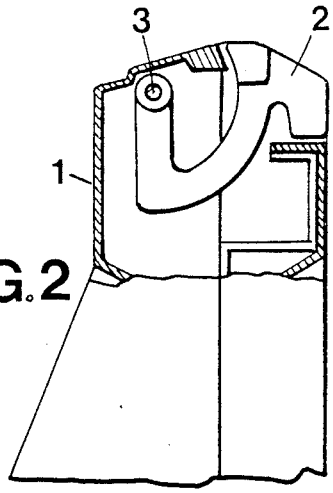
FIG. 2
FIG. 3
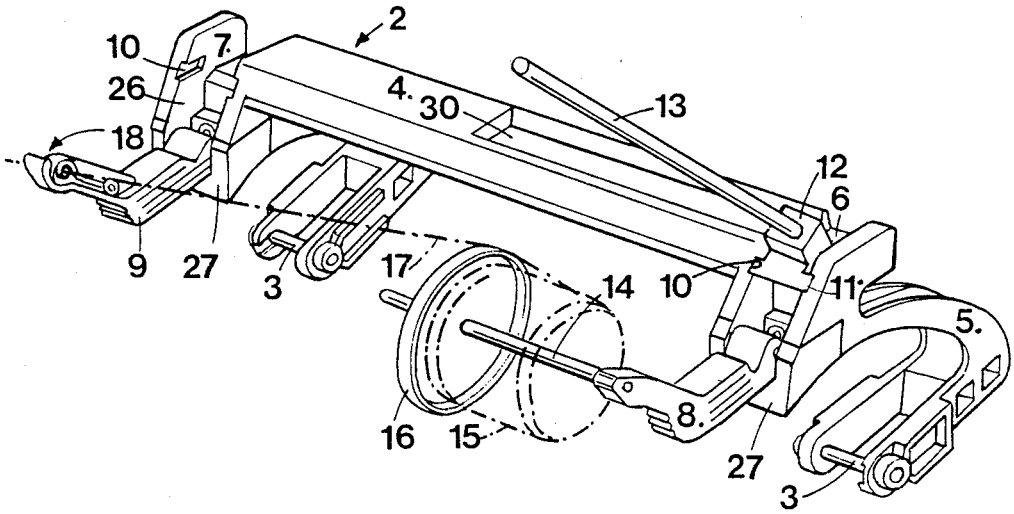

SEWING MACHINE WITH RETRACTABLE BOBBIN-CARRYING ROD AND THREAD GUIDE

There is already known a handle for a sewing machine having at each of its ends a curved portion adapted to be connected to the sewing machine, this handle carrying at least one bobbin-carrying rod. A handle of this type is disclosed particularly in Swiss Pat. No. 659,674.

In that patent, the unwinding of the thread from the bobbin takes place in a tangential direction. But it is known that there are advantages in unwinding the thread in the axial direction from a bobbin which remains stationary during unwinding, which gives more regular unwinding. A device permitting such unwinding in the axial direction is disclosed for example in U.S. Pat. No. 3,122,113.

The invention has for its object a new construction permitting such axial unwinding of the thread, in combination with a handle.

To this end, the handle according to the invention is characterized in that it has at each of its ends an arm displaceable from a retracted position toward an extended use position, one of these arms being adapted to carry a bobbin-carrying rod which is substantially parallel to the handle when this arm is in extended position, the other arm being provided with a thread guide located substantially on the axis of the bobbin-carrying rod when the two arms are in their extended position.

The accompanying drawings show schematically and by way of example an embodiment of the handle forming the object of the invention.

FIG. 1 is a view showing the handle in extended position, mounted on a sewing machine.

FIG. 2 shows this same handle in retracted position on the sewing machine.

FIG. 3 is a perspective view of the handle in use position.

Referring to FIGS. 1 and 2, a sewing machine 1, of which only the upper part is shown, is provided with a handle 2 articulated on pivots 3 coacting with the machine case so as to be able to assume an extended position, shown in FIG. 1, and respectively a retracted position, shown in FIG. 2, which is principally used for storage.

Figure 4:
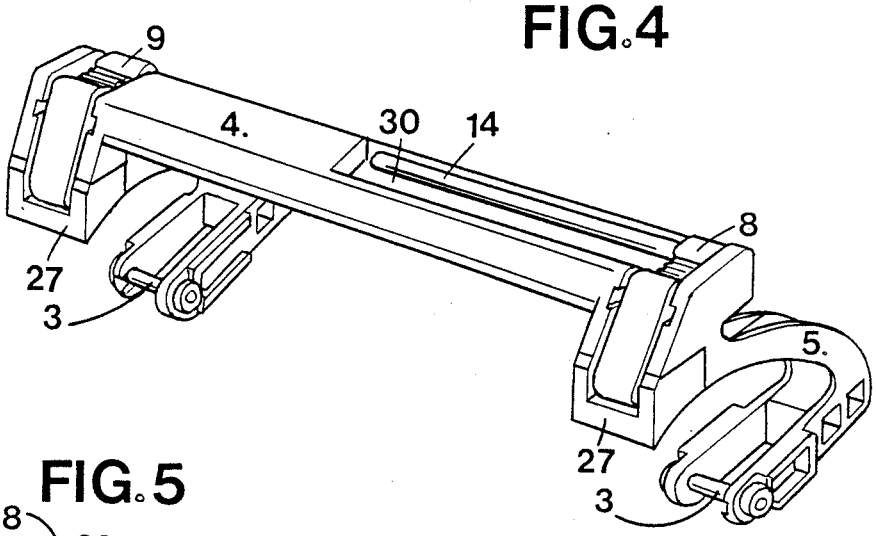
FIG. 4 is a perspective view of the handle with the bobbin carrier and the thread guide in retracted position.

Referring to FIGS. 3 and 4, it is apparent that the handle comprises a medial portion 4 which has at each of its ends a curved portion 5 carrying a pivot 3. These two pivots 3 are coaxial and parallel to the medial portion of the handle.

At each end of the medial portion 4, the handle has recesses 6 and 7 in which can be retracted two arms 8 and 9 pivotally mounted on an axis parallel to the medial portion 4.

The recesses 6 and 7 have guide grooves 10 in either of which can slide tongue 11 secured to a base 12 carrying a bobbin-carrying rod 13. In principle this bobbin-carrying rod 13 constitutes an accessory which is used only when it is desired to sew with two threads. When this is not the case, the base 12 and the rod 13 are removed from recess 6, so that the latter can receive the arm 8 when moving to the retracted position shown in FIG. 4. The arm 8 is provided with a bobbin-carrying rod 14 on which can be positioned a thread bobbin 15, shown in broken line. A disc 16, centrally pierced, is frictionally engaged on the rod 14 and serves on the one hand to retain axially the bobbin 13 and on the other hand to comprise a smooth bearing surface for the thread 17 which is unwound from the bobbin.

Figure 5:
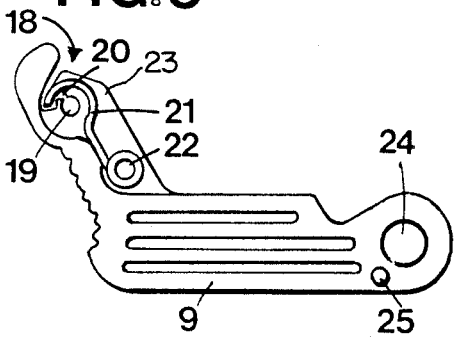
FIG. 5 is a detail view showing an arm carrying a thread guide.

This thread 17 passes through a thread guide 18 which is part of arm 9. This arm 9 with the thread guide is shown in greater detail in FIG. 5. This arm 9 can preferably be of molded plastic material and has a cylindrical hole 19 with longitudinal slot 20 opening outwardly of the arm and constituting the active part of the thread guide. A spring hook 21 permits introducing the thread into the hole 19 and making it pass parallel to itself through the slot 20 and then prevents the thread from escaping from this same slot The spring 21 is secured to the arm 2 by a tubular rivet 22 which extends through arm 9 and which constitutes a second thread guide adapted to be used when simultaneous sewing with two threads is performed. Although not shown in FIG. 5, the thread guide preferably has two hooks 21 disposed respectively on each side of the portion 23 of arm 9. FIG. 5 also shows that the arm 9 has a pivot 24 permitting pivoting of the arm 9 on the handle.

It should also be noted that the arm 9 has a boss 25 on each of its sides, these bosses being adapted to coact with recesses 26 (FIG. 3) to form catches resiliently retaining the arm 9 in its respective extended and retracted positions.

Figure 6:
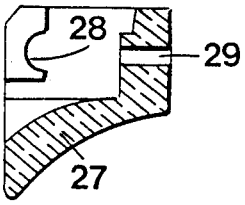
FIG. 6 is a cross-sectional view of a securement member.

FIG. 6 shows a member 7 which serves to retain the bearings 24 of the arm 9, as well as those of arm 8 which is articulated on the handle the same way as arm 9. This member 27 has a half a pillow block 28 to retain the bearings 24 which coact with another half pillow block provided within the recesses 6 and 7 respectively. This member 27 has also a passage 29 for securing it on the handle by means of a screw. This arrangement is preferable, because it permits easy removal of an arm to replace it with a new one if the user damages or breaks it.

Figure 7:
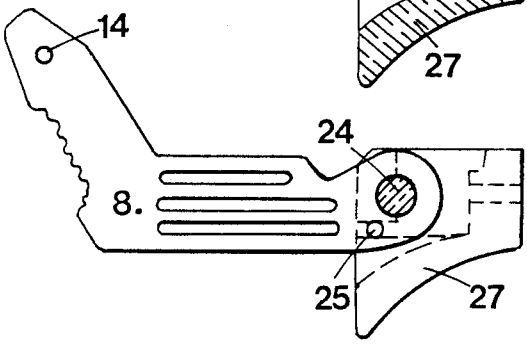
FIG. 7 is a partial view showing the bobbin-carrying arm in extended position.

FIG. 7 shows the arm 8 which is provided with the bobbin-carrying rod I4 and which is constituted in the same way as arm 9, that is it comprises a pivot 24 and a boss 25 to fix its respective extended and retracted positions.

As shown in FIGS. 3 and 4, the medial portion 4 of the handle has a recess 30 in which rod 14 is lodged when the arm 8 is in retracted position, as shown in FIG. 4.

Numerous modifications of the form of the described handle could of course be provided. It follows that the handle 2 need not necessarily be articulated on the machine 1 and that it could be rigidly fixed to the latter. The arms 8 and 9 could also be pivoted on the handle about non-parallel axes on the portion 4 of the handle, these axes being able to be for example vertical. The arms 8 and 9 need not necessarily be articulated on the handle and they could very well be disposed on the latter by mutual engagement of hollow or projecting parts, with if desired resilient or snap-catch retention means.

What is claimed is:

1. A handle in combination with a sewing machine, said handle having at each of its ends a portion adapted to be connected to the sewing machine, this handle carrying at least one bobbin-carrying rod having a longitudinal axis, said handle having at each of its ends an arm displaceable relative hereto, respectively from a retracted position toward an extended use position, one of these arms being adapted to carry said bobbin-carrying rod substantially parallel to the handle when the rod is extended position, the other arm having a thread guide located substantially on said axis of the bobbin-carrying rod when two arms are in their extended use position.

2. Handle according to claim 1, characterized in that the two arms are articulated on the handle about an axis parallel to the latter.

3. Handle according to claim 2, characterized in that elastic catches are provided between each arm and the handle to retain the arms in their extended and/or retracted positions.

4. Handle according to claim 2, characterized in that a grasping portion of the handle has a recess in which is disposed the bobbin-carrying rod when its arm is in retracted position.

5. Handle according to claim 1, characterized in that it has a portion adapted to receive a second bobbin-carrying rod.

6. Handle according to claim 5, characterized in that said arms are provided with at least two thread guides.

7. Handle according to claim 6, characterized in that the arm provided with thread guides has a cylindrical hole with a longitudinal slot opening outwardly of the arm, a hook spring being disposed adjacent an end of this hole and shaped to permit the introduction of a thread through the slot into the cylindrical hole and prevent it from leaving this slot.

8. Handle according to claim 7, characterized in that the hook is fixed to the arm by a tubular rivet engaged in a second cylindrical hole parallel to the first, this tubular rivet constituting a second thread guide.

9. Handle according to claim 7, characterized in that a hook spring is adjacent each of the ends of said hole.

10. Handle according to claim 1, characterized in that an end of each of said portions has means for articulation to a sewing machine.

11. Handle according to claim 10, in which said portions are curved so as to accommodate an edge of the sewing machine.

* * * * *